175-40 SR
8/12/80 XR 4,216,835

United States Patent [19]
Nelson

[11] 4,216,835
[45] Aug. 12, 1980

[54] SYSTEM FOR CONNECTING AN UNDERWATER PLATFORM TO AN UNDERWATER FLOOR

[76] Inventor: Norman A. Nelson, 2202 Sieber, Houston, Tex. 77017

[21] Appl. No.: 939,731

[22] Filed: Sep. 5, 1978

[30] Foreign Application Priority Data

Sep. 7, 1977 [GB] United Kingdom ..... 37328/77

[51] Int. Cl.[2] ..... E21B 15/02
[52] U.S. Cl. ..... 175/10; 175/7; 175/40; 166/338; 175/171
[58] Field of Search ..... 175/7, 9, 171, 5, 40, 175/45, 10; 166/358, 366, 362, 338, 360, 351, 352, 339, 340

[56] References Cited

U.S. PATENT DOCUMENTS

| | | | |
|---|---|---|---|
| 2,676,787 | 4/1954 | Johnson | 175/7 |
| 3,310,108 | 3/1967 | Yancey | 175/7 |
| 3,321,015 | 5/1967 | Word, Jr. | 166/340 |
| 3,519,071 | 7/1970 | Word, Jr. | 175/171 X |
| 3,701,549 | 10/1972 | Koomey et al. | 285/113 X |
| 3,901,331 | 8/1975 | Djurovic | 175/171 |
| 3,934,658 | 1/1976 | Nelson | 175/7 |
| 3,987,638 | 10/1976 | Burkhardt et al. | 175/9 X |
| 4,127,991 | 12/1978 | Regan | 175/7 X |

FOREIGN PATENT DOCUMENTS

| | | | |
|---|---|---|---|
| 1249440 | 10/1971 | United Kingdom | 175/7 |
| 1247646 | 9/1971 | United Kingdom | 175/7 |
| 174575 | 8/1965 | U.S.S.R. | 175/7 |

*Primary Examiner*—Ernest R. Purser
*Assistant Examiner*—Richard E. Favreau

[57] ABSTRACT

A modular underwater support platform having interconnecting elements is lowered into position by a conductor pipe which in turn is connected to and supported from a drill pipe. Releasable hydraulic connections connect the platform to the conductor pipe and connect the conductor pipe to the drill pipe. After the hydraulic connection between the platform and the conductor pipe is released, the drill pipe drills a hole in the subsea floor for receiving the conductor pipe. The conductor pipe is positioned in the hole, and locked to the platform for supporting the platform. A base may be connected to the bottom of the support platform which includes hydraulic cylinder and piston assemblies for leveling the support platform. Hydraulic control lines are positioned on the support platform and adapted to be in communication with the hydraulic connections when the conductor pipe is locked to the platform for hydraulically releasing the connections allowing the removal of the drill pipe.

3 Claims, 8 Drawing Figures

SYSTEM FOR CONNECTING AN UNDERWATER PLATFORM TO AN UNDERWATER FLOOR

BACKGROUND OF THE INVENTION

U.S. Pat. No. 3,934,658 discloses a system of modular underwater well platforms which are adapted to be connected to an underwater floor and to each other for forming a base support for a well drilling platform which can be positioned and installed as required depending upon drilling conditions encountered.

The present invention is directed to an improved system for connecting one or more modular underwater support platforms to the underwater floor with a minimum time and expense.

SUMMARY

The present invention is directed to a system for connecting an underwater support platform to the underwater floor in which the platform is initially supported from a conductor pipe which in turn is connected to a drill pipe. The interconnecting members are connected by releasable hydraulic connecting means and the system is lowered and the installation is completed in a single trip with the drill pipe.

A further object of the present invention is the provision of a system having a modular underwater support platform having interconnecting elements for allowing interconnection with other support platforms and which is connected to a conductor pipe by releasable hydraulic connecting means. A releasable hydraulic latch connector is connected to the conductor pipe and a releasable hydraulic swivel joint connector is connected to the latch connector. A drill pipe is releasably connected to the swivel joint connector for initially supporting said system and lowering it into position above the underwater floor. The drill pipe includes drilling means for drilling a hole in the underwater floor for receiving the conductor pipe. Locking means are provided between the conductor pipe and the support platform which are engaged when the releasable connecting means between the platform and the pipe is hydraulically released and the conductor pipe is positioned in the underwater hole.

Still a further object of the present invention is the provision of a base connected to the bottom of the support platform, hydraulic cylinder and piston assemblies connected between the base and the support platform for leveling the support platform, and level indicating means on the support platform for indicating the level of the platform whereby the platform may be leveled prior to cementing the conductor pipe in the hole.

Yet a still further object of the present invention is the provision of hydraulic control lines positioned on the support platform and adapted to be in communication with the releasable hydraulic latch connector and releasable hydraulic swivel joint when the connector pipe is locked to the platform for hydraulically releasing the latch connector and the swivel joint.

Yet a still further object of the present invention is the provision of an underwater hydraulic control pod releasably connected to the platform and connected to the hydraulic control lines for hydraulically controlling the various releasable hydraulic connecting means.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
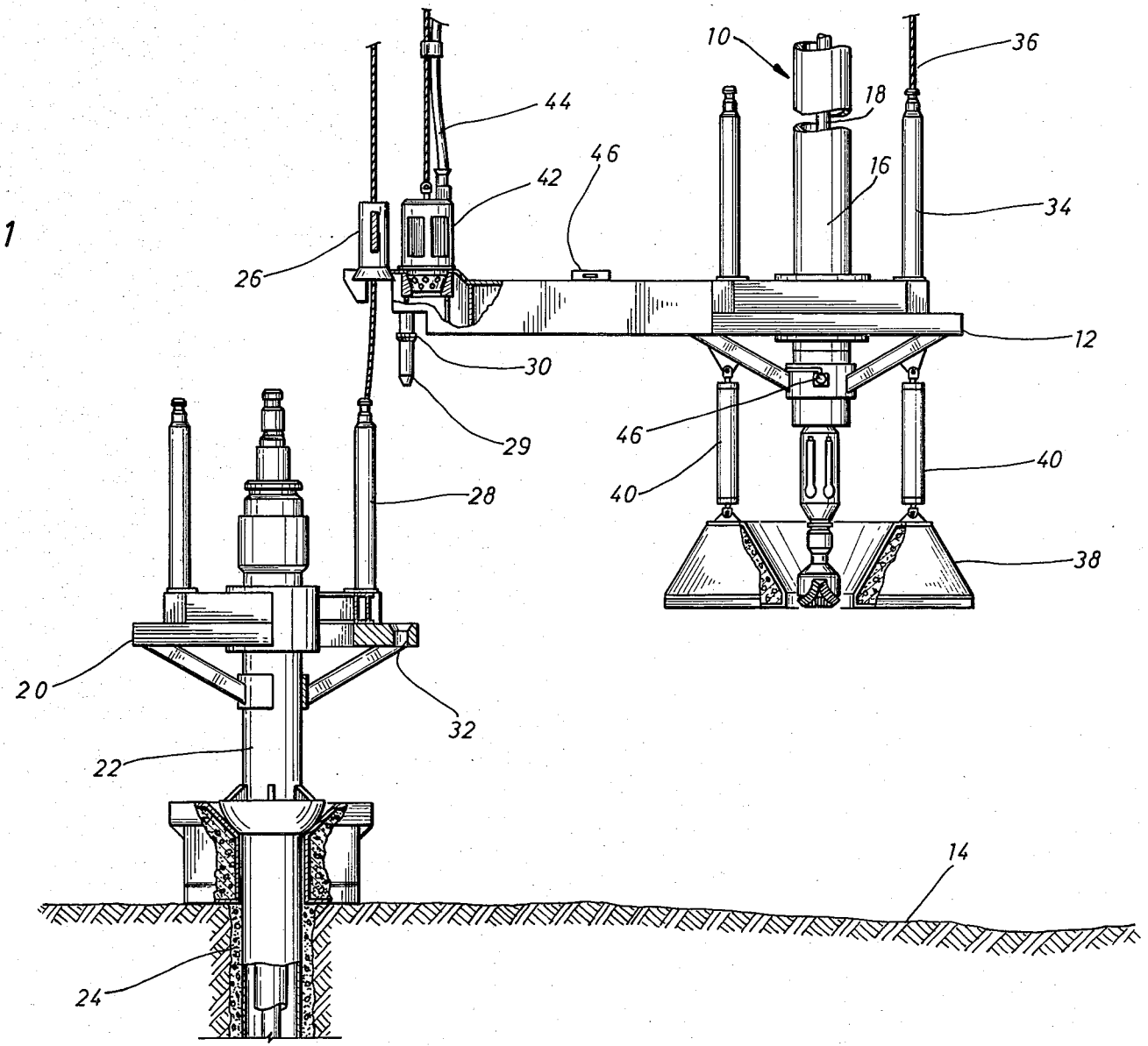
FIG. 1 is an elevational view, partly in cross section, in which a support platform is being lowered to the underwater floor and simultaneously connected to an existing underwater support platform.

The present invention is directed to a handling system for connecting an underwater support platform to an underwater floor, and if desired, connecting the underwater platform to a previously installed underwater platform, and to which further underwater platforms may be connected thereby forming an interconnecting subsea well platform for oil and gas well drilling and/or production. The handling system is generally referred to by the reference numeral 10 and includes a modular underwater support platform 12 which is to be set on an underwater floor 14, a conductor pipe 16 which is initially connected to and supports the platform 12 by a hydraulic latch 46, and a drill pipe 18 which is initially connected to the conductor pipe 16 for lowering and supporting the entire system 10.

As best seen in FIG. 1, the support platform 12 is being lowered towards the underwater floor 14 for connection thereto and if desired may be simultaneously connected to a previously set underwater platform 20 which is affixed to the underwater floor 14 through a conductor 22 which is secured to the floor 14 in a hole by cement 24 as generally described in U.S. Pat. No. 3,934,658. Thus, the platform 12 may include interconnecting elements such as guide 26 for engaging posts 28 of platform 20, and connector pin 28 and spring lock 30 for engagement with opening 32 of platform 20. Furthermore, platform 12 may include interconnecting elements such as upstanding posts 34 and guide and support lines 36 for connecting the underwater modular underwater platform 12 to still additional platforms.

If desired, the platform 12 may include a bottom support base 38 and hydraulic piston and cylinder leveling assemblies 40 which are hydraulically controlled through a control pod 42, more fully described in U.S. Pat. No. 3,701,549 which in turn is controlled from the water surface through control and power lines 44. The assemblies 40 are for the purpose of leveling the platform 12 in response to a suitable leveling indicator 46 which may provide a signal to the water surface. However, the base 38 and assemblies 40 may be omitted as the guide and support lines 36 may be used for leveling the platform 12. However, the base 38 and assemblies 40 are useful in providing a more steady and rigid support.

Figure 1A:
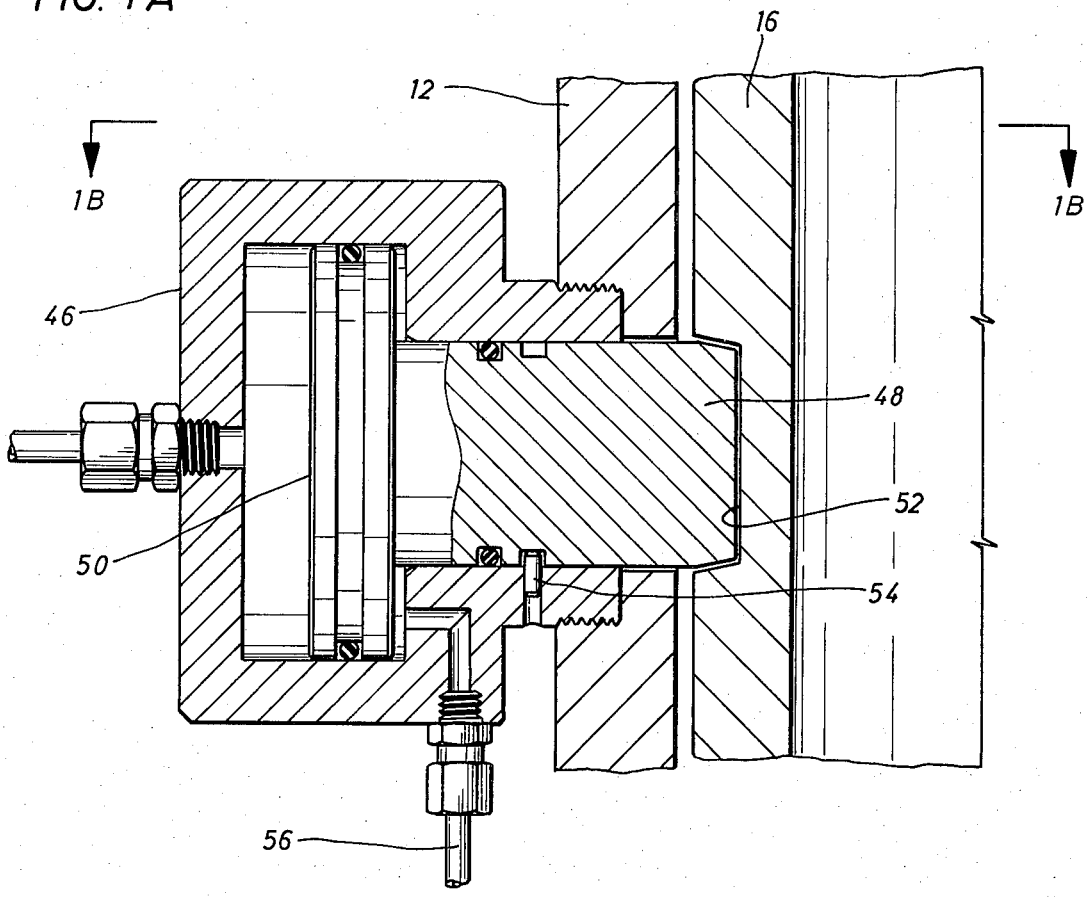
FIG. 1A is an enlarged fragmentary view, partly in cross section, showing a suitable hydraulic latch for initially connecting the support platform to a conductor pipe.
Figure 1B:
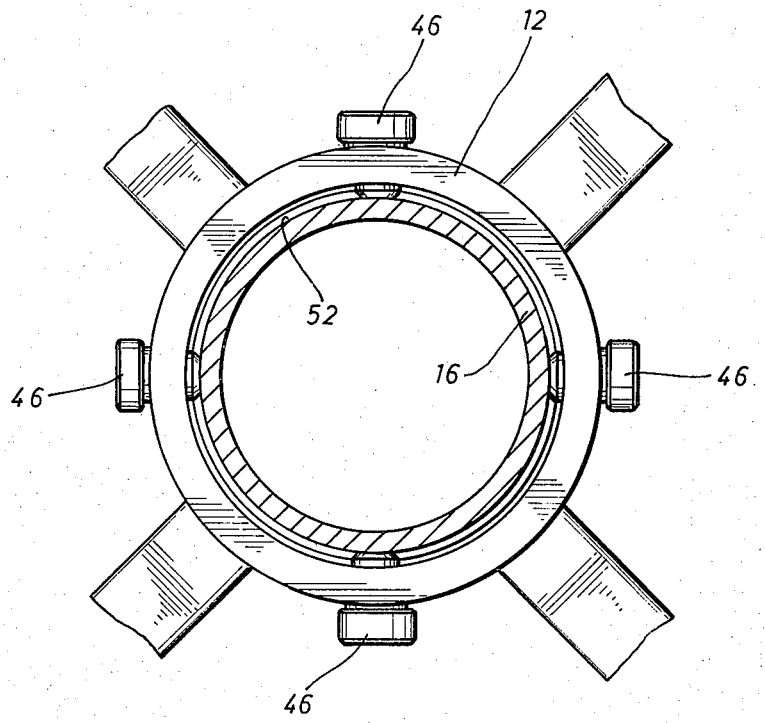
FIG. 1B is a cross-sectional view taken along the line 1B—1B of FIG. 1A.
Figure 2:
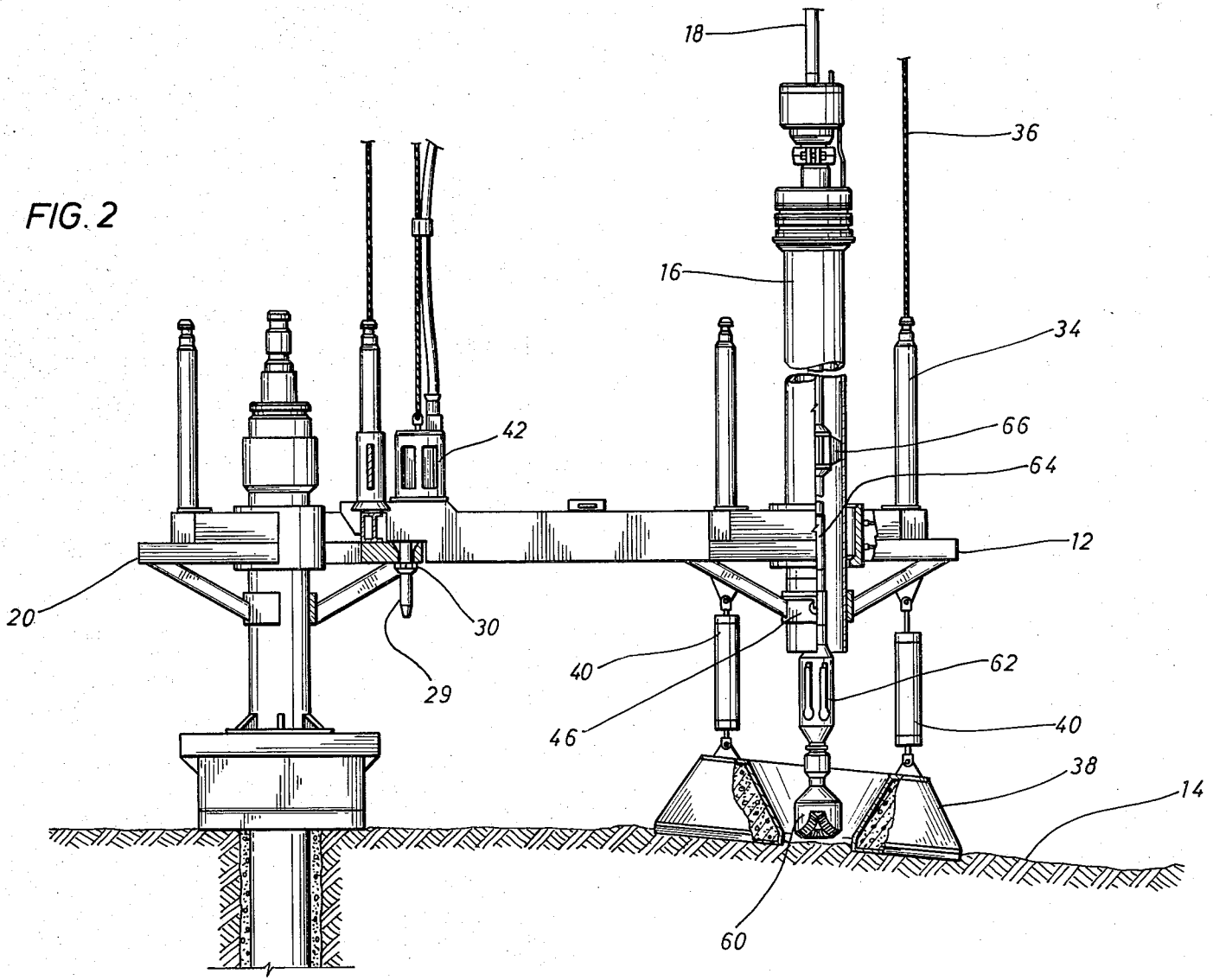
FIG. 2 is an elevational view, partly in cross section, showing the underwater platform lowered into position on an underwater floor and connected to an existing platform.

Referring now to FIG. 2, the platform 12 is lowered towards the underwater floor 14 by means of the drill pipe 18, is connected to platform 20, if desired, by latch 30. The base 38 is set on the floor 14, and the platform 12 is leveled through the hydraulic assemblies 40. Up to this point, the platform 12 has been connected to the conductor pipe 16 by one or more hydraulically operated latches 46 which are more fully shown in FIGS. 1A and 1B. The hydraulic latches 46 may be of any suitable type, such as a pin 48 connected to a piston 50 and supported from the platform 12. The pins 48 initially engage a groove 52 in the conductor pipe 16 and are initially held in the connecting position by a shear pin 54. When it is desired to release the latches 46, hydraulic fluid is applied from the pod 42 through the lines 56 to the pistons 50 which moves the pins 48 outwardly thereby releasing the connection between the platform 12 and the conductor 16. With the platform 12 set in position, as best seen in FIG. 2, the latches 46 are disconnected whereby the drill pipe 18 and conductor 16 may be lowered relative to the platform 12 for drilling a hole in the underwater floor 14 and setting the conductor pipe 16 in the hole.

Figure 2A:
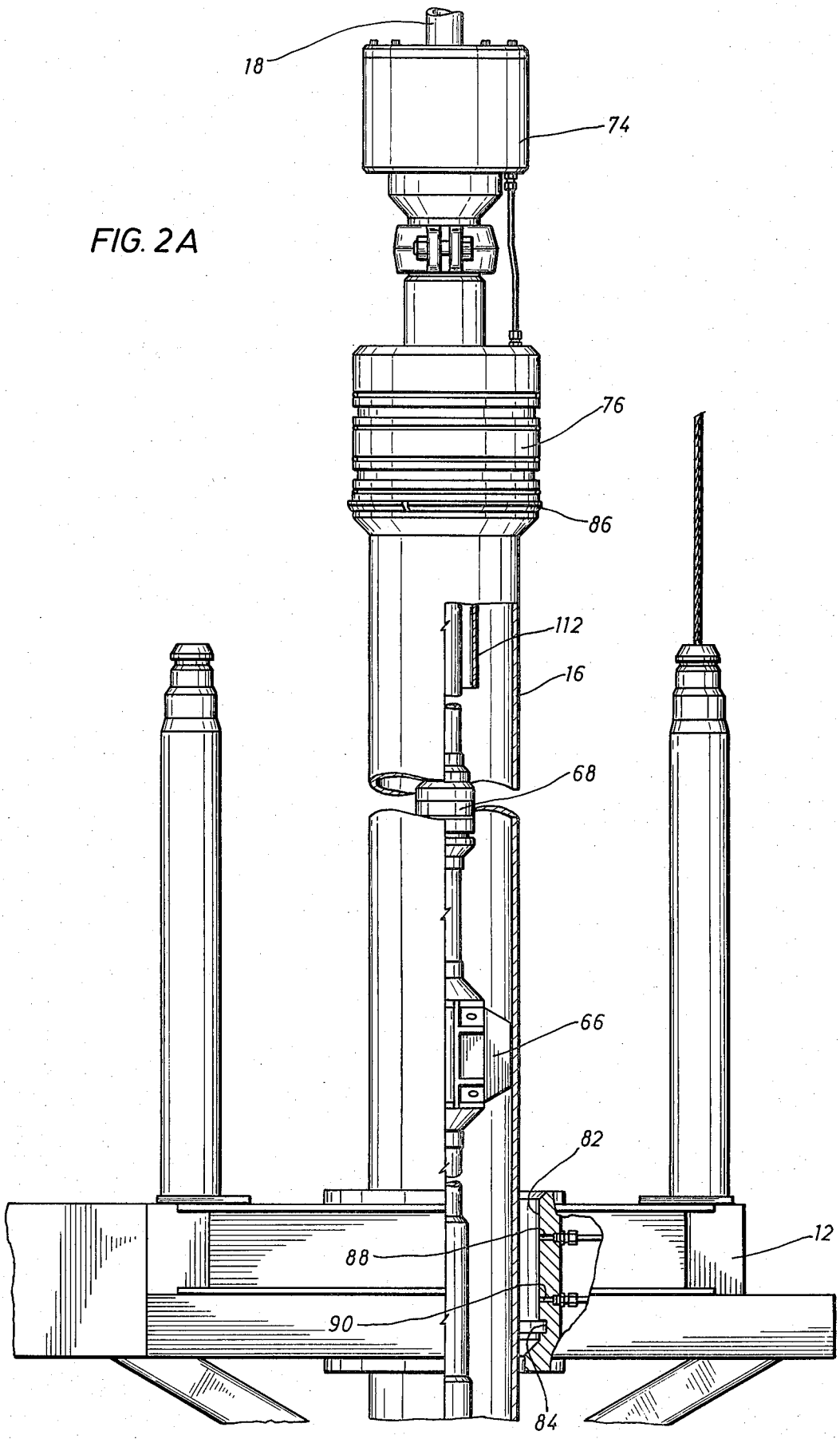
FIG. 2A is an enlarged elevational view, partly in cross section, illustrating the upper portion of the handling system for setting the platform.
Figure 2B:
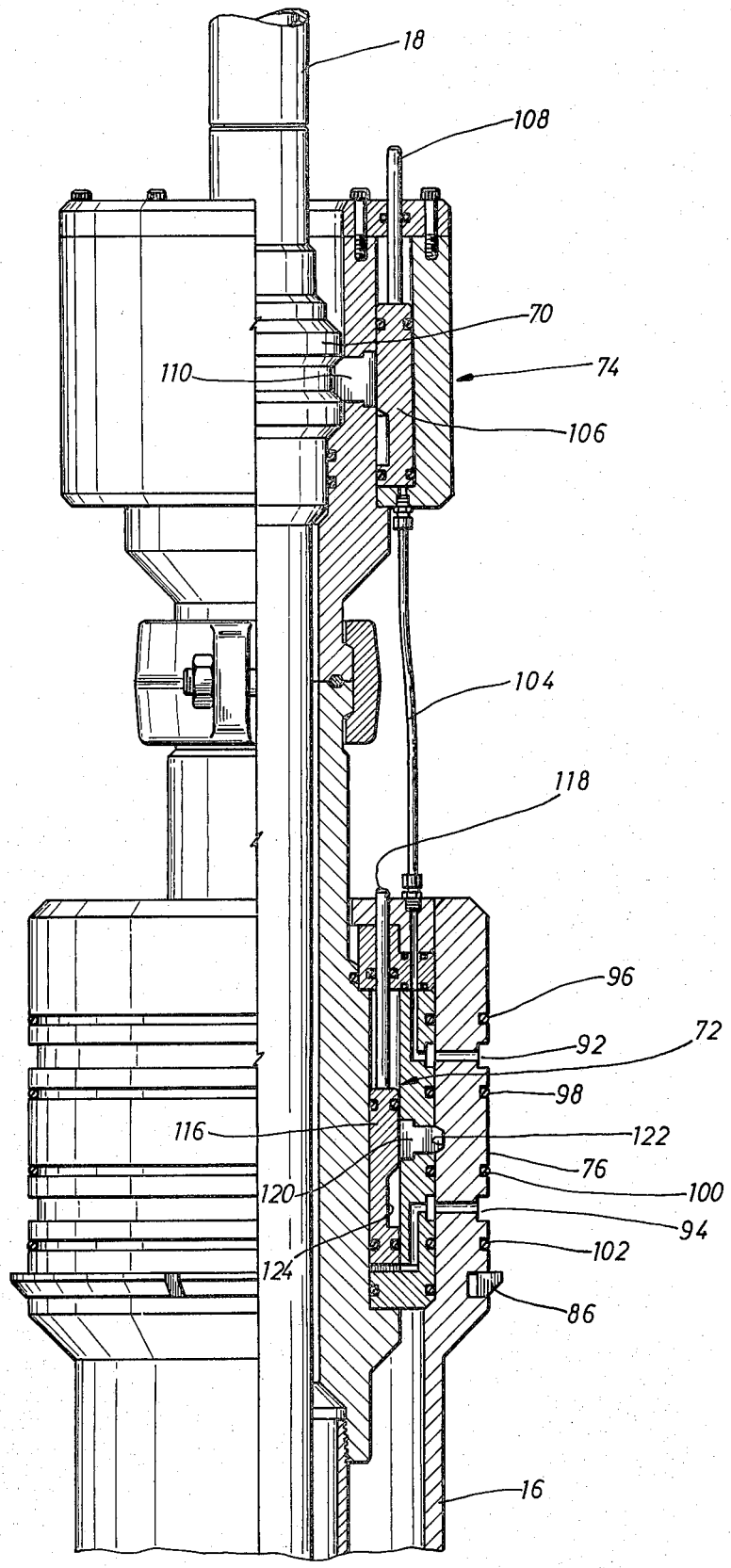
FIG. 2B is still a further enlarged elevational view, partly in cross section, of the top portion of the handling system shown in FIG. 2A.

As best seen in FIGS. 2, 2A, 2B the drilling assembly consists of suitable and conventional drilling and cementing means such as a drilling bit 60, an under reamer 62, hydraulic telescoping jars 64, a centralizer 66, a seal assembly 68, and a swivel assembly 70, all of which are connected to and supported from the drill pipe 18. As best seen in FIG. 2B, a hydraulic latch connector, generally indicated by the reference numeral 72, is connected to the head 76 of the conductor pipe 16 and in turn is connected to a releasable hydraulic swivel joint connector, generally indicated by the reference numeral 74, which is hydraulically locked initially to the swivel assembly 70. Thus, as the drill pipe 18 is lowered to drill a hole in the underwater floor by the drill bit 60, the conductor 16 is also lowered into the drilled hole but does not rotate because of the rotation between the swivel assembly 70 and the drill pipe 18.

Figure 3:
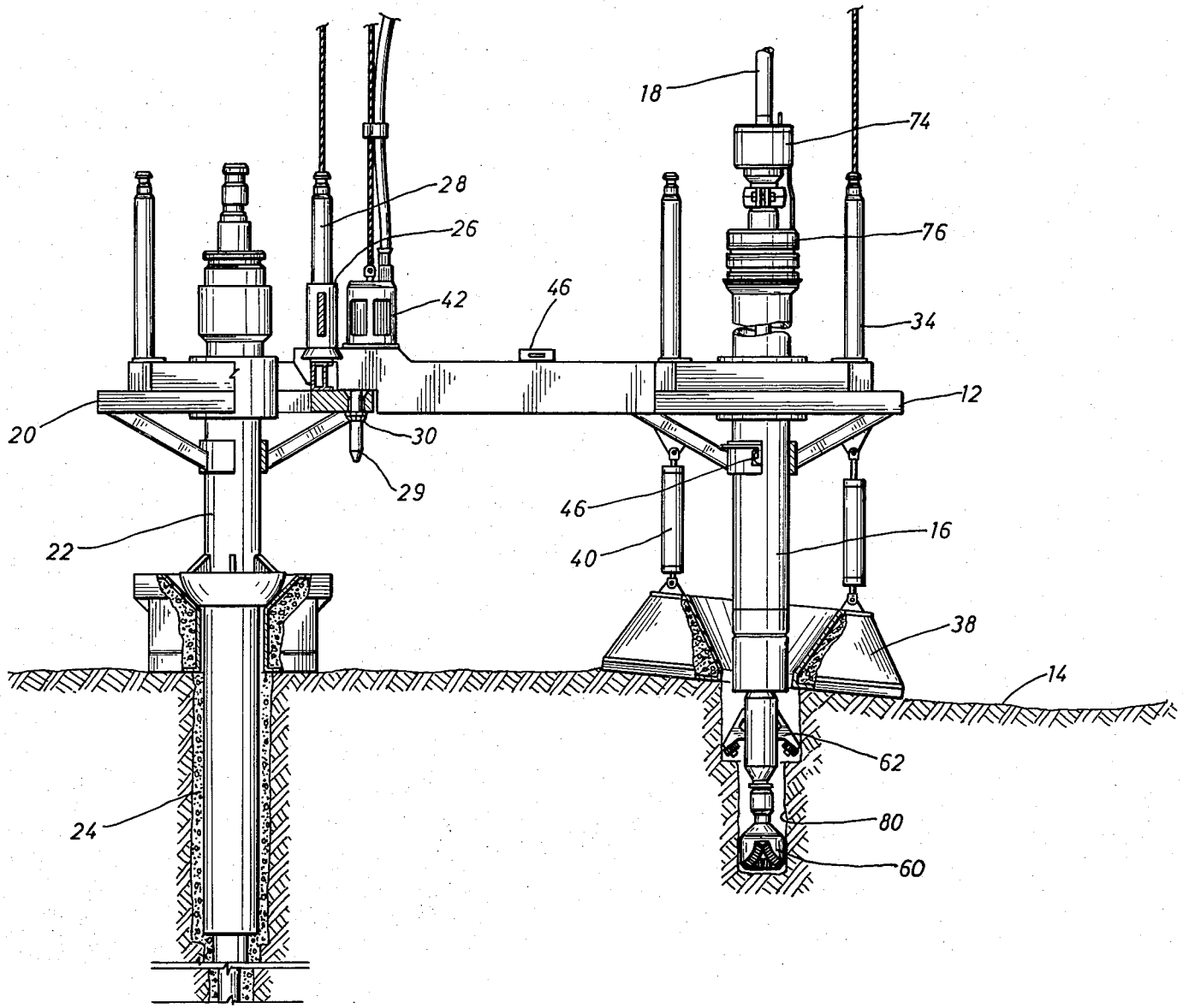
FIG. 3 is an elevational view, partly in cross section, illustrating the step of releasing the conductor pipe from the platform being set and drilling a hole in the underwater floor.

As best seen in FIG. 3, and as is conventional, circulating fluid flows down the drill string 18, expands the underreamer 62, energizes the telescoping jars 64 to force the drill bit 60 and reamer 62 downward with a force proportional to fluid pressure. As a hole 80 is drilled, the conductor 16 and drill pipe 18 are lowered and the drilling cuttings circulate up out of the hole 80 and around the exterior of the conductor 16.

Referring now to FIG. 2A, the platform 12 includes a opening 82 for receiving the head 76 of the conductor pipe 16. The opening 82 includes a locking notch 84 for receiving a locking ring 86 on the head 76 for locking the conductor pipe 16 to the base 12 when the hole 80 is sufficiently deep such that the conductor head 76 will seat in the opening 82 of the platform 12. The opening 82 also includes hydraulic ports 88 and 90 which are in communication with the pod 42 for supplying hydraulic fluid thereto for releasing the hydraulic latches 72 and 74.

Referring now to FIG. 2B, the conductor head 76 includes annular ports 92 and 94 which align with the ports 88 and 90, respectively, in the platform 12 and include annular seals 96, 98, 100, and 102 for sealing in the opening 82.

Thus, when the hole 80 is sufficiently deep that the conductor head 76 seats in the opening 82, the port 92 is aligned with the port 88 and the port 94 is aligned with the port 90. The port 92 is in communication through line 104 to the hydraulic latch connector 74 which is engaged to the swivel assembly 70. Initially, a piston 106 is moved downwardly by manual operation of a rod 108 to move in behind a plurality of locking dogs 110 which lock the latch 74 to the swivel assembly 70. Application of hydraulic fluid through the ports 88, 92, line 104, and to the bottom of the piston 106 releases the locking dogs 106 from the swivel joint 70 and disconnects the drill pipe 18 from the conductor 16 which at this time is supported by the platform 12.

Figure 4:
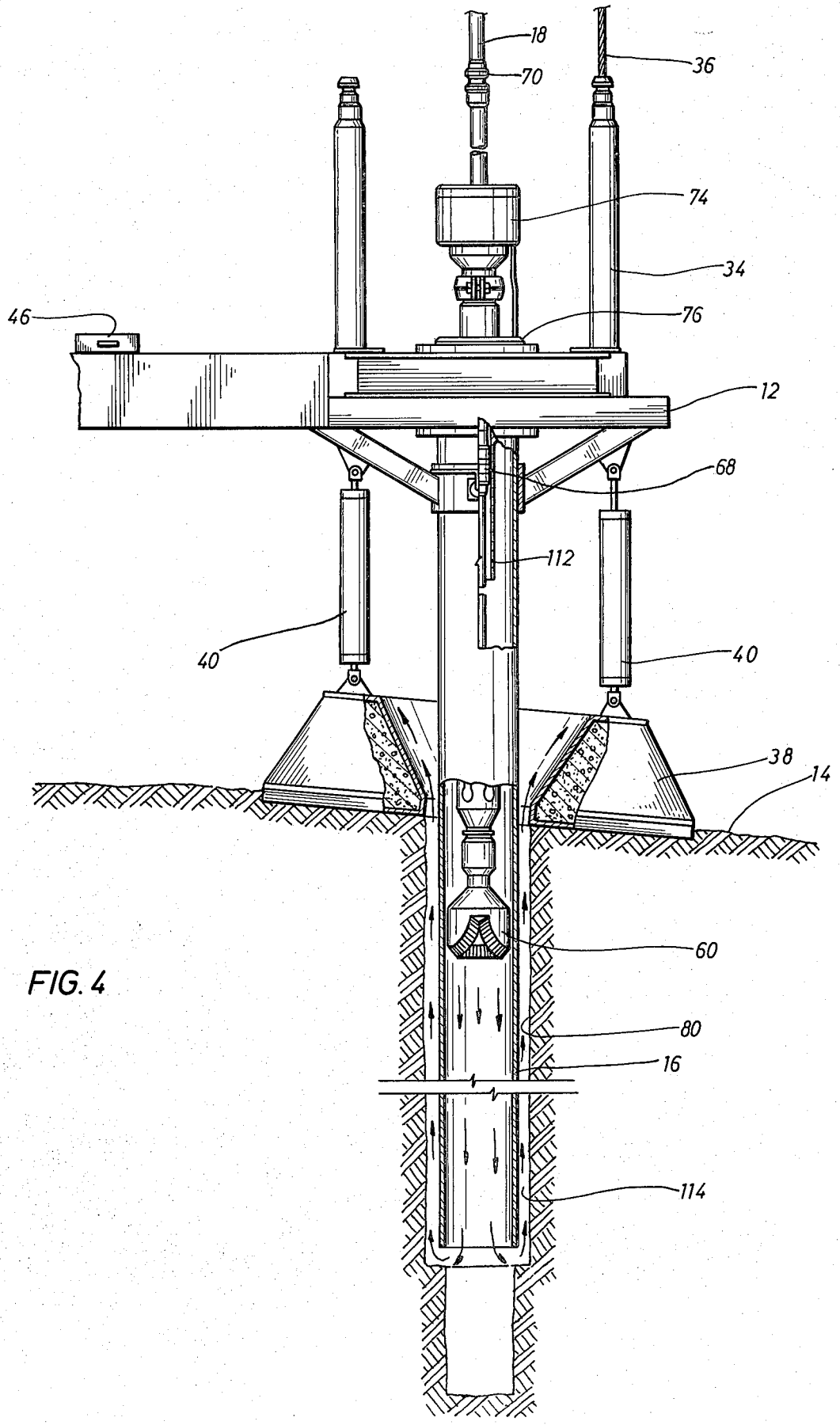
FIG. 4 is a fragmentary elevational view, partly in cross section, illustrating the position of the parts of the system in the process of cementing the conductor pipe in the hole in the subsea floor after which the drill pipe is removed.

With the hole 80 drilled, the conductor pipe 16 latched into the platform 12, and the drill pipe 18 disconnected from the conductor pipe 16, the conductor 16 may be cemented into the hole 80 if desired, such as by raising the drill pipe 18 to move the sealing assembly 68 (FIG. 2A) up into the interior of the tube 112. The drill string 18 is then sealed at the top and cementing operations may proceed as best seen in FIG. 4 in which cement circulation down the drill string 18 flows out of the bit 60 and down the inside of the conductor 16 and up the annulus 114 between the hole 80 and conductor 16. The cement slurry is followed by heavy mud and the cement volume is sufficient to fill the annulus 114 and the inside of the conductor 16 and is displaced out of the bit 60 to assure that no further cement remains in the drill string 18 and bit 60. The position of the platform 12 is adjusted by use of the hydraulic piston and cylinder assemblies 40 or the guide lines 36, if necessary, to assure that the platform 12 will be level after the cement cures.

The hydraulic latch connector 72 is then released to release the drilling string 18 and allow the drilling string 18 and connected components including the drill bit 60 to be removed. That is, hydraulic fluid is supplied from the control pod 42 to the port 90 on the platform 12 to the annular port 94 (FIG. 2B) in the conductor head 96 to release the hydraulic latch 72. The latch 72 includes a piston 116 which is initially moved downwardly by a rod 118 to move into engagement with the back of a plurality of locking dogs 120 which engage an annular groove 122 in the conductor head 96. Passage of hydraulic fluid through the port 94 moves the piston 120 upwardly placing the notch 124 behind the locking dogs 120 allowing the releasable connection 72 to be disconnected from the conductor pipe 16. The drill string 18 and entire drilling assembly and hydraulic releasable connections 72 and 74 can then be pulled out of the conductor pipe 16. The control pod 42 may be removed later if desired.

When the cement around the conductor cures, the platform 12 is securely held in place on the underwater floor 14 whereby subsequent drilling operations may be carried out through the conductor pipe 12 and additional platforms may be connected to the platform 12 or 20 if desired.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. A handling system for connecting a modular underwater support platform to the underwater floor comprising, a modular underwater support platform having interconnecting elements for allowing interconnection with additional support platforms, support means for supporting the support platform, off of the underwater floor, a conductor pipe for supporting said support platform, releasable hydraulic connecting means connecting the support platform to the conductor pipe, a releasable hydraulic latch connector connected to the conductor pipe, a releasable hydraulic swivel joint connector connected to the latch connector, a drilling pipe releasably connected to the swivel joint connector for initially supporting said conductor pipe and said support platform in position above the underwater floor, drilling means on said drilling pipe for drilling a hole in the underwater floor for receiving said conductor pipe, locking means between the conductor and said support platform which are engaged when the hydraulic connecting means between the platform and the conductor pipe are hydraulically released and the conductor pipe is positioned in the underwater floor hole, level indicating means on said support platform for indicating the level of the platform whereby the platform may be leveled prior to cementing the conductor pipe in the hole, a base connected to the bottom of the support platform, and hydraulic cylinder and piston assemblies connected between the base and the support platform for leveling the support platform.

2. A handling system for connecting an underwater support platform to the underwater floor comprising, an underwater support platform, guide and support lines extending upwardly from the platform, a conductor pipe for supporting said support platform, releasable hydraulic connecting means connecting the platform to the conductor pipe, a releasable hydraulic latch connector connected to the conductor pipe, a releasable hydraulic swivel joint connected to the latch connector, a drilling pipe releasably connected to the swivel joint connector for initially supporting said conductor pipe and said platform in position above the underwater floor, drilling means on the drilling pipe for drilling a hole in the subsea floor for receiving said conductor pipe, locking means between the conductor pipe and said platform which are engaged when the hydraulic connecting means between the platform and the conductor pipe are hydraulically released and the conductor pipe is positioned in the underwater floor hole, hydraulic control lines positioned on the platform and adapted to be in communication with the releasable hydraulic latch connector and the releasable hydraulic swivel joint when the connector pipe is locked to the platform for hydraulically releasing said latch connector and the swivel joint, and an underwater hydraulic control pod releasably connected to the platform and is connected to said hydraulic control lines and to said releasable hydraulic connecting means.

3. A handling system for connecting an underwater support platform to the underground floor comprising, an underwater support platform, guide and support lines extending upwardly from the platform, a conductor pipe slideably connected to the support platform, releasable hydraulic connecting means initially connecting and supporting the platform from the conductor pipe, a releasable hydraulic latch connected to the conductor pipe and having a first actuating port, a releasable hydraulic swivel joint connector, connected to the latch connector and having a second actuating port, a drilling pipe releasably connected to the swivel joint connector for initially supporting said conductor pipe and said platform in position above the underwater floor, drilling means on the drilling pipe for drilling a hole in the underwater floor for receiving said conductor pipe, engagable locking means between the conductor pipe and said platform which are engaged only when the conductor pipe is positioned in the hole in the subsea floor, and hydraulic control lines positioned on the support platform and adapted to coact with the first and second actuating ports for releasing the hydraulic latch connector and hydraulic swivel joint only when the connector pipe is locked to the support platform.

* * * * *